US006427561B1

(12) United States Patent
Huang

(10) Patent No.: US 6,427,561 B1
(45) Date of Patent: Aug. 6, 2002

(54) STRAP WRENCH FOR DRIVING TUBULAR MEMBERS

(76) Inventor: Wu Sheng Huang, No. 108-24, Chong Chin Road, Bei Tun Chu, Taichung (TW), 406

( * ) Notice: Subject to any disclaimer, the term of this patent is extended or adjusted under 35 U.S.C. 154(b) by 0 days.

(21) Appl. No.: 09/930,982

(22) Filed: Aug. 17, 2001

(51) Int. Cl.[7] ..... B25B 13/52

(52) U.S. Cl. ..... 81/64

(58) Field of Search ..... 81/3.43, 64

(56) References Cited

U.S. PATENT DOCUMENTS 6,125,723 A 10/2000 Huang ..... 81/64

*Primary Examiner*—D. S. Meislin

(57) ABSTRACT

A strap wrench includes a handle extended from a head, a channel formed through the head and the handle for slidably receiving a strap. The strap has one end secured to the head, and has a middle loop for receiving an object to be driven. A pawl has a middle portion pivotally secured to the head with a pivot shaft, and includes one or more teeth disposed on one end for engaging with the strap and a lever extended from the other end. The teeth of the pawl may be forced to engage with the strap when the lever is forced toward the head by the loop and the object.

7 Claims, 4 Drawing Sheets

STRAP WRENCH FOR DRIVING TUBULAR MEMBERS

BACKGROUND OF THE INVENTION

1. Field of the Invention

The present invention relates to a strap wrench, and more particularly to a strap wrench for driving tubular members.

2. Description of the Prior Art

Typical strap wrenches are developed for driving tubular members. The applicant has developed one of the typical strap wrenches and disclosed in U.S. Patent No. 6,125,723 to Huang. The strap wrench includes a pawl or a cam biased to engage with a strap that may be used for clamping and driving the tubular members. However, the cam may not be used to solidly engage with the is strap.

The present invention has arisen to mitigate and/or obviate the afore-described disadvantages of the conventional strap wrenches.

SUMMARY OF THE INVENTION

The primary objective of the present invention is to provide a strap wrench including a pawl that may be solidly forced to engage with the strap for preventing the strap from being moved relative to the pawl, and for allowing the strap to solidly engage and clamp the object to be driven or rotated.

In accordance with one aspect of the invention, there is provided a strap wrench comprising a head including a handle extended therefrom, and including a channel formed along the head and the handle, a strap slidably engaged through the channel of the head and the handle, and including a first end secured to the head, and including a middle portion having a loop formed therein for receiving an object to be driven by the strap wrench, and a pawl including a middle portion pivotally secured to the head with a pivot shaft, and including a first end having at least one tooth provided thereon for engaging with the strap and for securing the strap to the head, and including a second end having a lever extended therefrom. The tooth of the pawl is allowed to be forced to engage with the strap when the lever is forced toward the head by the loop and the object.

The head includes a chamber formed therein for receiving the pawl, and includes a partition provided between the channel and the chamber of the head, the partition includes an orifice formed therein for receiving the tooth of the pawl and for allowing the tooth of the pawl to be engaged with the strap.

A spring biasing device is further provided for biasing the tooth of the pawl to engage with the strap and includes a spring blade extended from the pawl and engaged with the head for biasing the tooth of the pawl to engage with the strap and for further solidly forcing the tooth of the pawl to engage with the strap and thus for further solidly securing the strap to the head.

The head includes a bulge extended therein, the spring blade includes a first end extended from the pawl and includes a second end engaged with the bulge for allowing the spring blade to bias the tooth of the pawl to engage with the strap.

The lever of the pawl includes a hand grip provided for rotating the lever relative to the head and for disengaging the tooth of the pawl from the strap and for allowing the strap to be freely slid relative to the head and the handle.

The head includes an opening and an aperture formed therein for slidably receiving the strap, the aperture of the head includes a width greater than that of the opening of the head, the first end of the strap includes an enlarged latch provided thereon and engaged in the opening of the head for detachably securing the latch in the opening of the head.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
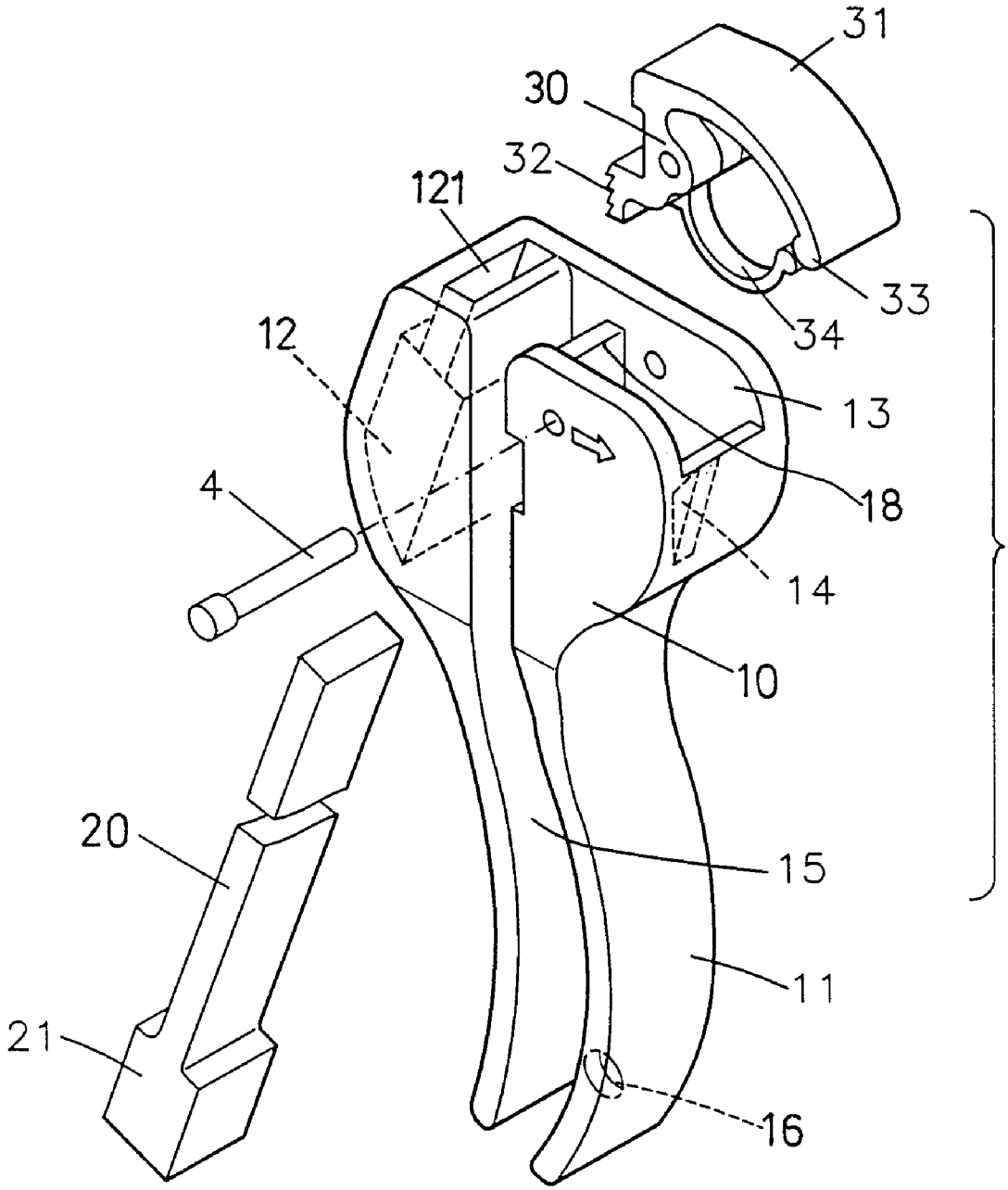
FIG. 1 is an exploded view of a strap wrench in accordance with the present invention.
Figure 2:
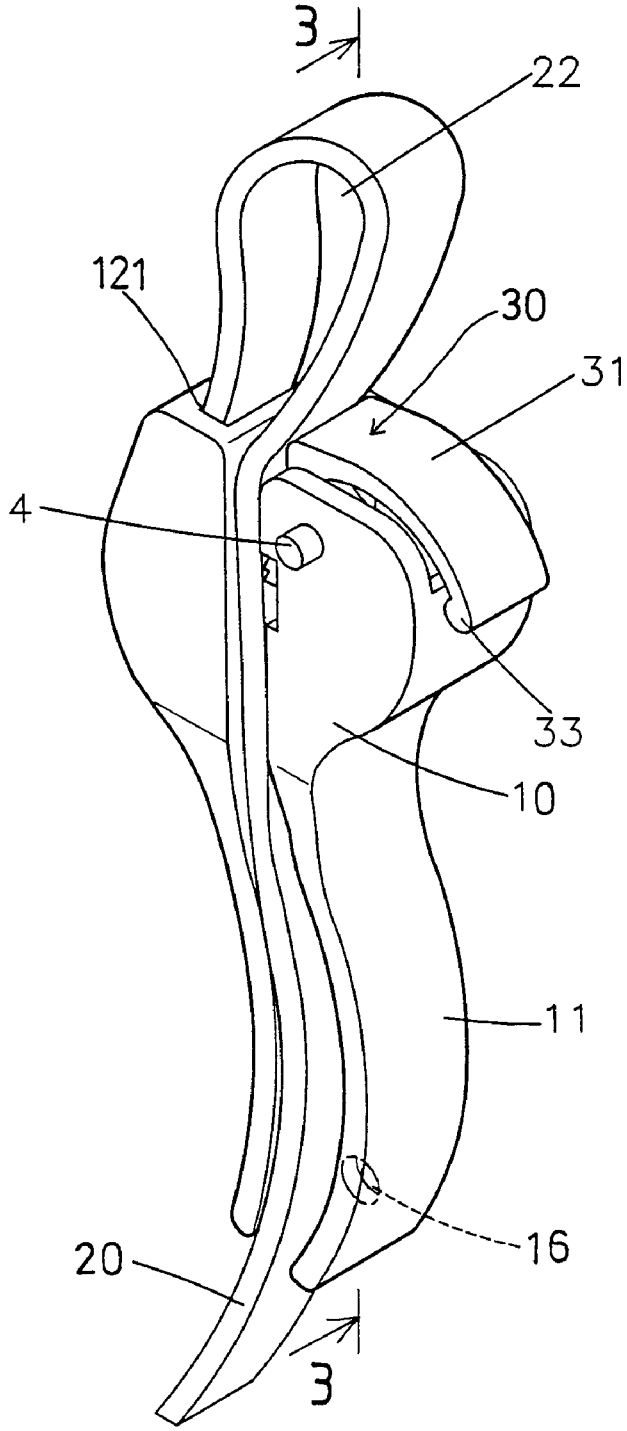
FIG. 2 is a perspective view of the strap wrench.
Figure 3:
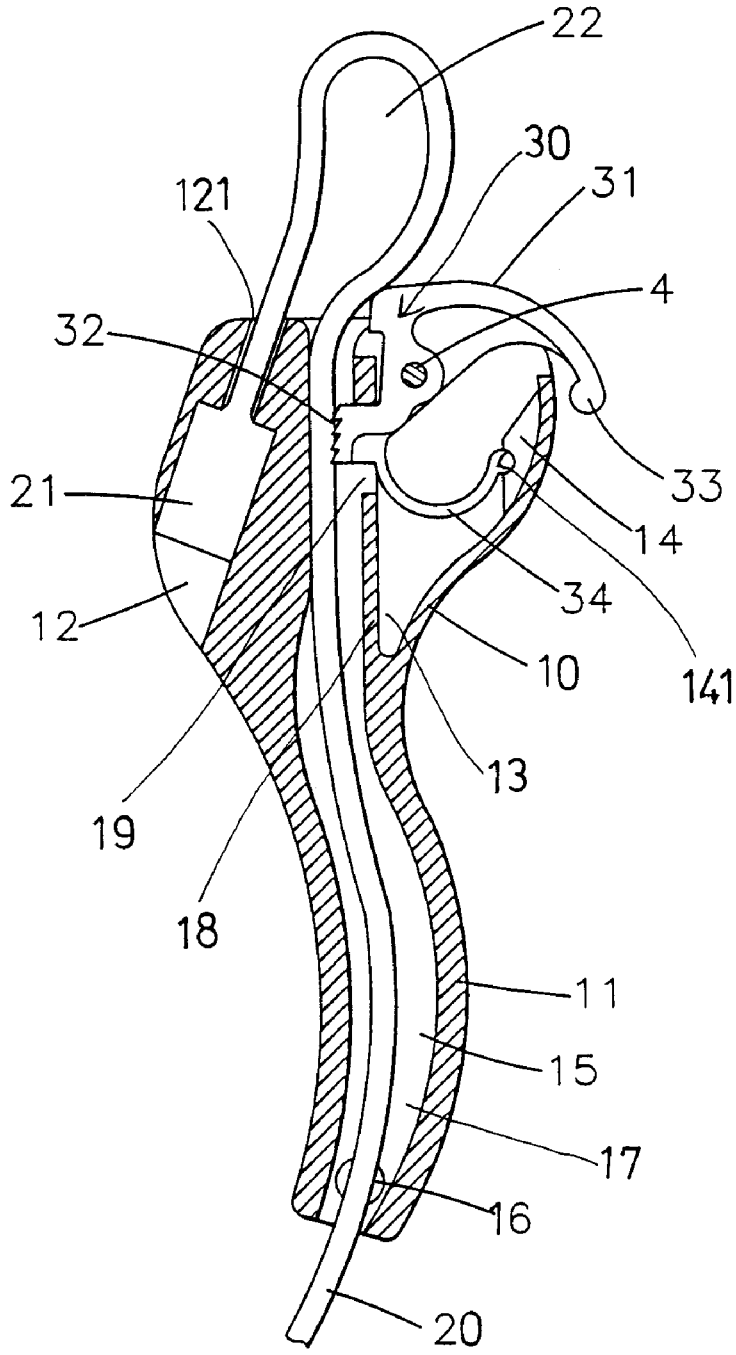
FIG. 3 is a cross sectional view taken along lines 3—3 of FIG. 2.

Referring to the drawings, and initially to FIGS. 1–3, a strap wrench in accordance with the present invention comprises a body or a head 10 including a handle 11 extended downward therefrom, and a channel 15 formed therein, particularly formed through the head 10 and the handle 11 for slidably receiving a strap 20 that is provided for engaging with the object 5 (FIG. 4) to be rotated or driven by the strap wrench. The handle 11 preferably includes a width or a thickness less than that of the body or of the head 10 for allowing the handle 11 to be suitably grasped by the users. The head 10 includes one side, such as the left side having a stepped hole, or having an opening 12 and an aperture 121 formed therein, in which the opening 12 includes a width or a thickness greater than that of the aperture 121 of the head 10. The head 10 includes a chamber 13 formed therein, such as formed in the right side thereof, and includes a partition 18 formed or provided between the chamber 13 and the channel 15 thereof. The partition 18 includes an orifice 19 formed therein and communicating with or between the chamber 13 and the channel 15 of the head 10. The head 10 and/or the handle 11 includes a hole 16 formed in a rear wall 17 thereof (FIGS. 3, 4) for allowing the strap wrench to be hooked or attached to the supporting nails (not shown) or the like.

The strap 20 is slidably engaged through the channel 15 of the head 10 and of the handle 11 and engaged through the aperture 121 and the opening 12 of the head 10, and includes an enlarged head or latch 21 formed or provided on one end thereof and having a width or thickness or area equals to that of the opening 12 of the head 10 and greater than that of the aperture 121 of the head 10, such that the latch 21 may be stably secured and retained within the opening 12 of the head 10 and such that the latch 21 may be detachably secured in the head 10. The middle portion of the strap 20 may be extended outward of the head 10 for forming a loop 22 (FIGS. 2–4) and for receiving and forcing and retaining the object 5 therein, and for allowing the object 5 to be rotated or driven by the strap wrench. The other end of the strap 20 is extended outward of the handle 11 for allowing the strap 20 to be pulled relative to the handle 11.

A pawl 30 is received in the chamber 13 of the head 10 and includes a middle portion pivotally or rotatably secured to the head 10 with a pivot shaft 4 for allowing the pawl 30 to be rotated relative to the head 10. The pawl 30 includes one end having one or more teeth 32 formed or provided thereon and extended through the orifice 19 of the partition 18 for engaging with the strap 20 (FIGS. 3, 4) and for securing the strap 20 to the head 10 and for solidly securing the object 5 to the head 10 by the strap 20. A spring, such as a spring blade 34 has one end secured to the pawl 30 or extended from the pawl 30, and has the other end engaged in a notch 141 of a bulge 14 that is extended inward of the chamber 13 of the head 10, for biasing the teeth 32 of the pawl 30 to engage with the strap 20 and for further solidly securing the object 5 to the head 10 by the strap 20. The pawl 30 includes a lever 31 extended or provided on the other end thereof and extended outward of the head 10 and having a hand grip 33 provided thereon for rotating the pawl 30 against the spring blade 34 and for disengaging the teeth 32 of the pawl 30 from the strap 20, and for allowing the strap 20 to be freely moved relative to the head 10 and the handle 11.

Figure 4:
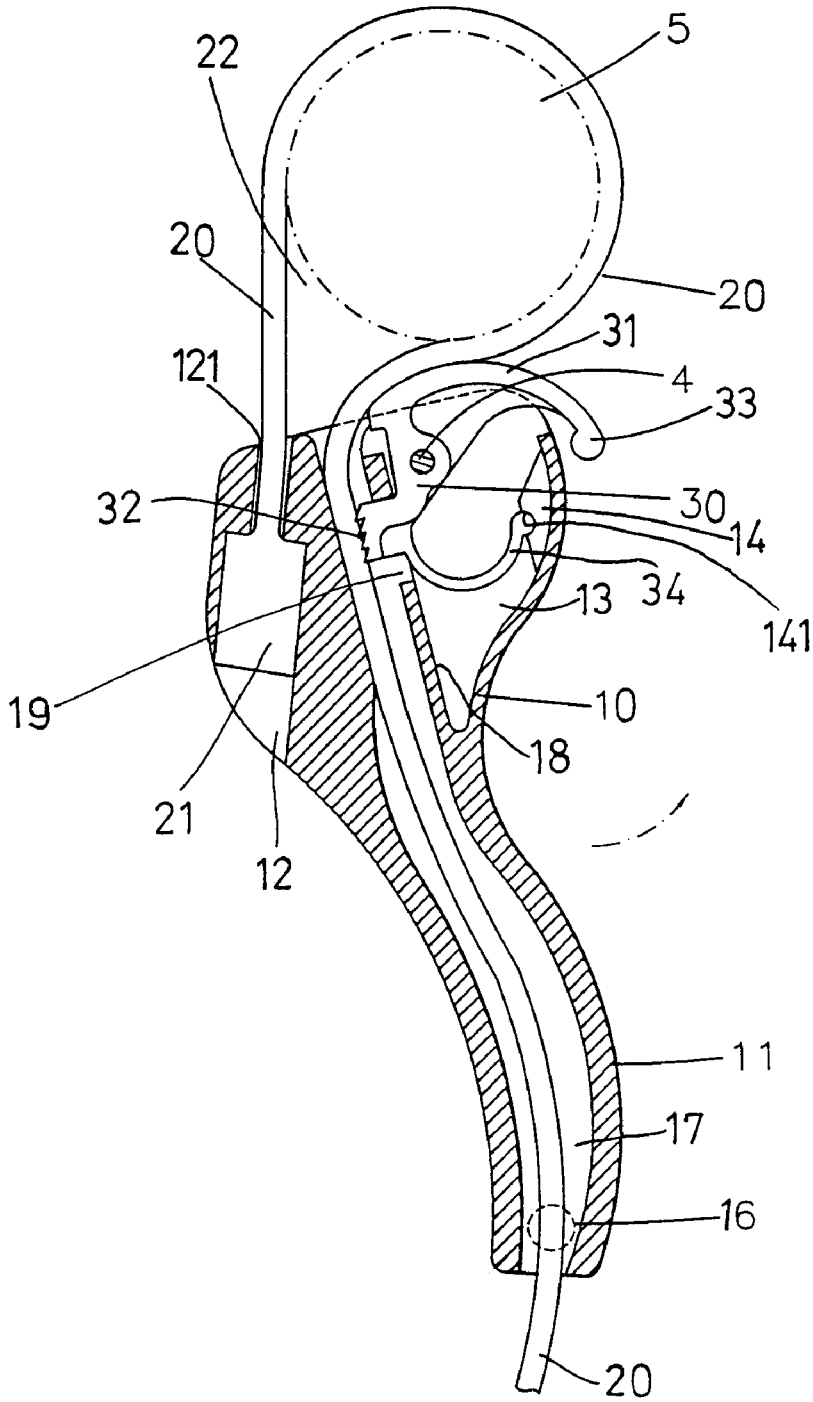
FIG. 4 is a cross sectional view similar to FIG. 3, illustrating the operation of the strap wrench.

In operation, as shown in FIG. 4, the object 5 to be driven by the strap wrench may be engaged into the loop 22 of the strap 20. The strap 20 may then be pulled relative to the handle 11 in order to solidly secure the object 5 within the loop 22 of the strap 20. The spring blade 34 may bias the teeth 32 of the pawl 30 to engage with the strap 20 and to solidly secure the strap 20 to the head 10 and to prevent the strap 20 from becoming loose. In addition, the users may also force the object S toward or to engage with the lever 31 of the pawl 30 and to force or to rotate the lever 31 inward or toward the head 10 and to further force the teeth 32 of the pawl 30 to engage with the strap 20 and to further solidly secure the strap 20 to the head 10, such that the object 5 may further be solidly rotated or driven by the strap 20 of the strap wrench.

The prior strap wrenches do not teach a pawl having one or more teeth for engaging with the strap and having a lever for being forced to engage with the strap while driving the object.

Accordingly, the strap wrench in accordance with the present invention includes a pawl that may be solidly forced to engage with the strap for preventing the strap from being moved relative to the pawl, and for allowing the strap to solidly engage and clamp the object, such as the tubular members or the cylindrical members to be driven or rotated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I Claim:

1. A strap wrench comprising:

a head including a handle extended therefrom, and including a channel formed through said head and said handle, a strap slidably engaged through said channel of said head and said handle, and including a first end secured to said head, and including a middle portion having a loop formed therein for receiving an object to be driven by said strap wrench, and a pawl including a middle portion pivotally secured to said head with a pivot shaft, and including a first end having at least one tooth provided thereon for engaging with said strap and for securing said strap to said head, and including a second end having a lever extended therefrom, said at least one tooth of said pawl being allowed to be forced to engage with said strap when said lever is forced toward said head by said loop and the object.

2. The strap wrench according to claim 1, wherein said head includes a chamber formed therein for receiving said pawl, and includes a partition provided between said channel and said chamber of said head, said partition includes an orifice formed therein for receiving said at least one tooth of said pawl and for allowing said at least one tooth of said pawl to be engaged with said strap.

3. The strap wrench according to claim 1 further comprising means for biasing said at least one tooth of said pawl to engage with said strap.

4. The strap wrench according to claim 3, wherein said biasing means includes a spring blade extended from said pawl and engaged with said head for biasing said at least one tooth of said pawl to engage with said strap.

5. The strap wrench according to claim 4, wherein said head includes a bulge extended therein, said spring blade includes a first end extended from said pawl and includes a second end engaged with said bulge.

6. The strap wrench according to claim 1, wherein said lever of said pawl includes a hand grip provided for rotating said lever relative to said head and for disengaging said at least one tooth of said pawl from said strap.

7. The strap wrench according to claim 1, wherein said head includes an opening and an aperture formed therein for slidably receiving said strap, said aperture of said head includes a width greater than that of said opening of said head, said first end of said strap includes an enlarged latch provided thereon and engaged in said opening of said head for detachably securing said latch in said opening of said head.

* * * * *